US009784032B2

(12) United States Patent
Perkins et al.

(10) Patent No.: US 9,784,032 B2
(45) Date of Patent: Oct. 10, 2017

(54) DUAL TURNSTILE

(71) Applicant: Boon Edam, Inc., Lillington, NC (US)

(72) Inventors: Mark Perkins, Eaton Rapids, MI (US); John Boyle, Apex, NC (US); Kurt Measom, Fuquay Varina, NC (US); Thomas Dolenschek, Clayton, NC (US)

(73) Assignee: Boon Edam, Inc., Lillington, NC (US)

( * ) Notice: Subject to any disclaimer, the term of this patent is extended or adjusted under 35 U.S.C. 154(b) by 13 days.

(21) Appl. No.: 14/837,874

(22) Filed: Aug. 27, 2015

(65) Prior Publication Data

US 2016/0060944 A1 Mar. 3, 2016

Related U.S. Application Data

(60) Provisional application No. 62/042,423, filed on Aug. 27, 2014.

(51) Int. Cl.
*E06B 11/08* (2006.01)
*G07C 9/02* (2006.01)

(52) U.S. Cl.
CPC ..... *E06B 11/08* (2013.01); *G07C 9/02* (2013.01)

(58) Field of Classification Search
CPC ..... G07C 9/02; G07C 9/025; E05G 5/003; E05G 5/02; E05F 15/73; E05F 15/608; E06B 11/08; E06B 11/085; E06B 11/02; E06B 3/90; E06B 3/906
USPC ..... 49/42, 49
See application file for complete search history.

(56) References Cited

U.S. PATENT DOCUMENTS 2,258,896 A * 10/1941 Kelker, Jr. ..... E06B 11/08 49/42
3,681,751 A * 8/1972 Le Barre ..... G07F 17/145 235/93
3,988,570 A * 10/1976 Murphy ..... G06Q 10/0635 194/210
4,184,289 A * 1/1980 Lambertson ..... E06B 11/08 49/42
4,811,247 A * 3/1989 Malady ..... G07C 9/00 340/540
5,204,671 A * 4/1993 Kronberg ..... G06F 7/76 340/12.18
6,745,520 B2 * 6/2004 Puskaric ..... E05G 5/003 49/142
7,119,682 B1 * 10/2006 Fisher ..... E05G 5/003 109/3
7,135,980 B2 * 11/2006 Moore ..... G07C 9/02 340/5.2
8,112,938 B2 * 2/2012 Bolduc ..... E06B 11/085 49/141
2003/0133597 A1 * 7/2003 Moore ..... G07C 9/02 382/115
2006/0225352 A1 * 10/2006 Fischer ..... G07C 9/00158 49/49
2006/0278704 A1 * 12/2006 Saunders ..... G06Q 20/10 235/382

(Continued)

*Primary Examiner* — Justin Rephann
(74) *Attorney, Agent, or Firm* — Ward and Smith, P.A.; Ryan K. Simmons

(57) ABSTRACT

A turnstile having two hub and arm assemblies funnels individuals to different sides or lanes. Machine intelligence allows the turnstile to select which side or lane an individual transits. The turnstile may randomly, pseudo-randomly, or strategically which side or lane an individual transits.

25 Claims, 17 Drawing Sheets

(56) References Cited

U.S. PATENT DOCUMENTS

| | | | | |
|---|---|---|---|---|
| 2007/0271846 | A1* | 11/2007 | Miller | E06B 11/085 49/49 |
| 2011/0100405 | A1* | 5/2011 | Fournier | E04H 1/1227 135/96 |
| 2012/0184350 | A1* | 7/2012 | Romano | G07C 15/006 463/22 |
| 2013/0120108 | A1* | 5/2013 | Kocznar | E06B 11/085 340/5.7 |
| 2013/0205666 | A1* | 8/2013 | Fortin | E06B 11/022 49/13 |

* cited by examiner

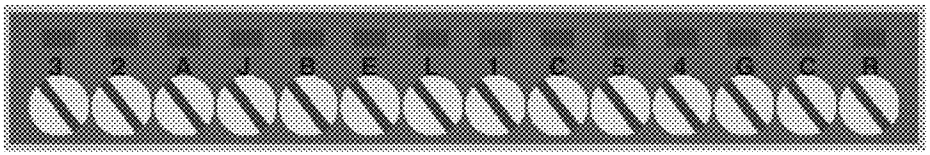

4.8.4 Internal connection

| Connection | | Color | | |
|---|---|---|---|---|
| 3 | 18 – 20 VAC | Black | | |
| 2 | 18 – 20 VAC | Black | | |
| A | Key Switch Override | Red | | |
| J | Key Switch Override | Orange | | |
| L | Rotation switch - NC contact | White | Entry | |
| | | Grey | Exit | |
| C | Rotation switch - COM contact | Black | | |
| | Rotation switch - NO contact | Yellow | Counter | Option |
| 1 | Non-powered Counter | Red | | Option |
| C | Battery powered Counter | Red | | Option |
| 5 | Solenoid | White | | |
| 4 | Solenoid | White | | |

4.8.5 External connection

| Connection | | Color | |
|---|---|---|---|
| 3 | 24 VDC – | Black | Alternative Power Supply |
| 2 | 24 VDC + | Black | Alternative Power Supply |
| A | Input switch | Red | See input options |
| B | Input switch | Blue | See input options |
| E | Ground Sinking Input Switch | Violet | See input options |
| C | Ground Sinking Input Switch | Black | See input options |
| G | Green lamp | Green | |
| C | Common lamps | Black | |
| R | Red lamp | Red | |
| A – J | Fire alarm | | |

FIG. 13

DUAL TURNSTILE

CROSS-REFERENCE TO RELATED APPLICATION

This utility patent application claims the benefit of U.S. Provisional Patent Application No. 62/042,423, entitled "Dual Turnstile with Random Selector," filed on Aug. 27, 2014 and incorporated herein by reference in its entirety.

BACKGROUND

Secure access and exit to areas is important. With today's security concerns, turnstiles can be used to control entryways and exits of various facilities. For example, by funneling individuals into single files for controlled access or exiting of a premise, and may also help facilitate visual inspection and searches of individuals prior to entry and/or exit.

BRIEF DESCRIPTION OF THE SEVERAL VIEWS OF THE DRAWINGS

The features, aspects, and advantages of the exemplary embodiments are understood when the following Detailed Description is read with reference to the accompanying drawings, wherein:

FIGS. 12-14 illustrate circuitry componentry, according to exemplary embodiments;

DETAILED DESCRIPTION

The exemplary embodiments will now be described more fully hereinafter with reference to the accompanying drawings. The exemplary embodiments may, however, be embodied in many different forms and should not be construed as limited to the embodiments set forth herein. These embodiments are provided so that this disclosure will be thorough and complete and will fully convey the exemplary embodiments to those of ordinary skill in the art. Moreover, all statements herein reciting embodiments, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those of ordinary skill in the art that the diagrams, schematics, illustrations, and the like represent conceptual views or processes illustrating the exemplary embodiments. The functions of the various elements shown in the figures may be provided through the use of dedicated hardware as well as hardware capable of executing associated software. Those of ordinary skill in the art further understand that the exemplary hardware, software, processes, methods, and/or operating systems described herein are for illustrative purposes and, thus, are not intended to be limited to any particular named manufacturer.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

It will also be understood that, although the terms first, second, etc. may be used herein to describe various elements, these elements should not be limited by these terms. These terms are only used to distinguish one element from another. For example, a first device could be termed a second device, and, similarly, a second device could be termed a first device without departing from the teachings of the disclosure.

Figure 1:
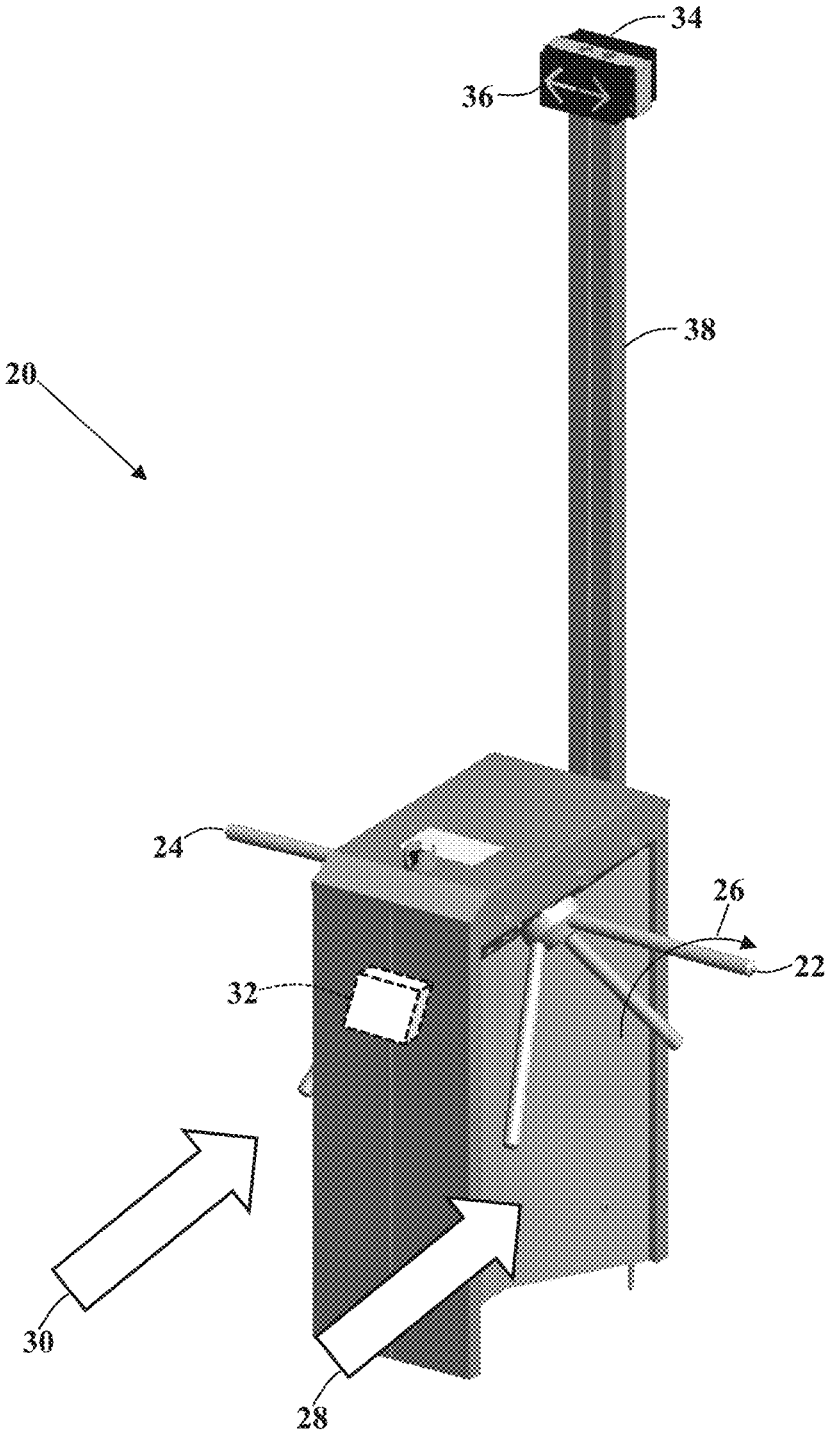
FIG. 1 illustrates a dual turnstile, according to exemplary embodiments.

FIG. 1 illustrates a turnstile, such as a dual turnstile 20, according to exemplary embodiments. The dual turnstile 20 is illustrated as a waist-high unit sized for most individuals. Exemplary embodiments, though, may be applied to different sizes and configurations of turnstiles, such as full-height cages and gates. The reader is assumed to be familiar with turnstiles, so this disclosure need not dwell on the known details. In general the dual turnstile 20 has a right side (as illustrated by a right hub and arm assembly 22) and a left side (represented by a left hub and arm assembly 24). As the reader understands, the assemblies 22 and 24 may rotate in one direction and lock to prevent rotation in an opposite direction. The assemblies 22 and 24 thus may permit individuals to pass through from one direction, but the assemblies 22 and 24 may also prevent passage in the opposite direction.

Here, though, passage may be selective. The assemblies 22 and 24 may be commanded to engage in the same direction 26. The right hub and arm assembly 22, for example, creates a right lane 28. The left hub and arm assembly 24 creates a left lane 30. As an individual approaches the dual turnstile 20, a passage mechanism 32 senses or detects the individual and assigns either the right lane 28 or the left lane 30. That is, the passage mechanism 32 unlocks one of the assemblies 22 or 24 for passage. Suppose, for example, the passage mechanism 32 selects the right hub and arm assembly 22. The passage mechanism 32 may nearly simultaneously lock the opposite left hub and arm assembly 24. The passage mechanism 32 may also visually indicate the selected lane, such as causing illumination or display of a lane indicator 34 (illustrated as a graphical arrow 36). FIG. 1 illustrates the lane indicator 34 prominently elevated by a sign post 38. Exemplary embodiments, for example, may illuminate a "left" arrow 36 in green to indicate the left lane 30. The individual observes the lane indicator 34 and walks along and through the left lane 30, thus spinning the unlocked left hub and arm assembly 24 and the individual is therefore permitted to directly exit the location. However, had the individual attempted the right lane 28, the right hub and arm assembly 22 is locked to prevent transit there through. In another exemplary embodiment, for example, a "right" arrow 36 in red may illuminate to indicate the individual must pass through right lane 28, e.g., for pre-exit (or pre-entry) processing/screening. The individual observes the lane indicator 34 and walks along and through the right lane 28, thus spinning the unlocked right hub and arm assembly 22, and the individual is therefore directed to an area for pre-exit processing/screening, such as, security screening, searching. However, had the individual attempted the left lane 30, the left hub and arm assembly 24 is locked to prevent transit.

Exemplary embodiments thus direct individuals into different areas. Assume, for example, the dual turnstile 20 is operating in an arena, coliseum, warehouse, distribution center, or other facility. As the individuals approach the dual turnstile 20, some individuals may exit the facility directly, while other individuals may be directed to a different lane leading to a different area, e.g., for pre-exit processing/screening. Indeed, the passage mechanism 32 may implement different strategies or tactics for selecting lanes, as this disclosure will explain. The passage mechanism 32 may even be manually controlled, thus allowing security personnel or others to manually select the desired lane.

Figure 2:
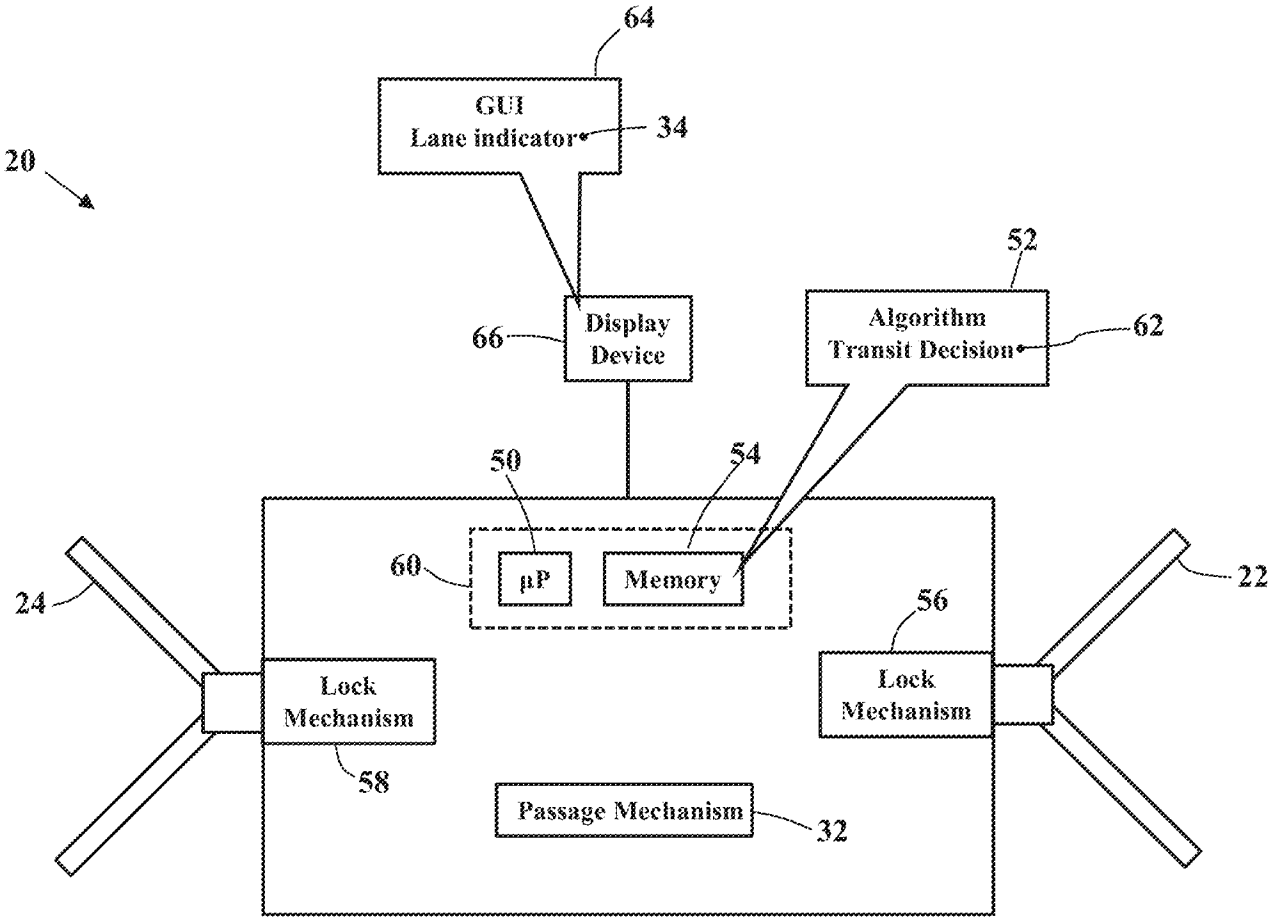
FIG. 2 is a block diagram of the dual turnstile, according to exemplary embodiments.

FIG. 2 is a block diagram of the dual turnstile 20, according to exemplary embodiments. The dual turnstile 20 has a processor 50 (e.g., "μP"), application specific integrated circuit (ASIC), or other component that executes an algorithm 52 stored in a local memory 54. The algorithm 52 includes instructions, code, and/or programs that select either the right hub and arm assembly 22 and/or the left hub and arm assembly 24. Each assembly 22 and 24 has a corresponding lock mechanism 56 and 58. The processor 50, the algorithm 52, and the memory 54 may thus function as a lock controller 60 that interfaces with the lock mechanisms 56 and 58. When an individual approaches the dual turnstile 20, the passage mechanism 32 informs the processor 50 of a presence of the individual. The algorithm 52 instructs the processor 50 to determine a transit decision 62. The transit decision 62 causes the processor 50 to activate one of the lock mechanisms 56 or 58, thus locking the corresponding hub and arm assembly 22 or 24. The transit decision 62 may also cause the processor 50 to deactivate the opposite or other lock mechanism 56 or 58, thus unlocking the corresponding hub and arm assembly 22 or 24. The algorithm 52 may also causes the processor 50 to generate a graphical user interface (or "GUI") 64 for display by a display device 66. The graphical user interface 64 displays the lane indicator 34, thus visually alerting the individual to the selected lane 28 and/or 30 (as FIG. 1 illustrated). Wherein, one of lanes 28 or 30 allow for the individual to directly exit (or enter) the facility, and wherein one of lanes lane 28 or 30 directs the individual to area for pre-exit (or entry) screening.

Exemplary embodiments may utilize any processing component, configuration, or system. Any processor could be multiple processors, which could include distributed processors or parallel processors in a single machine or multiple machines. The processor 50 can be used in supporting a virtual processing environment. The processor 50 could include a state machine, application specific integrated circuit (ASIC), programmable gate array (PGA) including a Field PGA, or state machine. When the processor 50 executes instructions to perform "operations", this could include the processor 50 performing the operations directly and/or facilitating, directing, or cooperating with another device or component to perform the operations.

Figure 3:
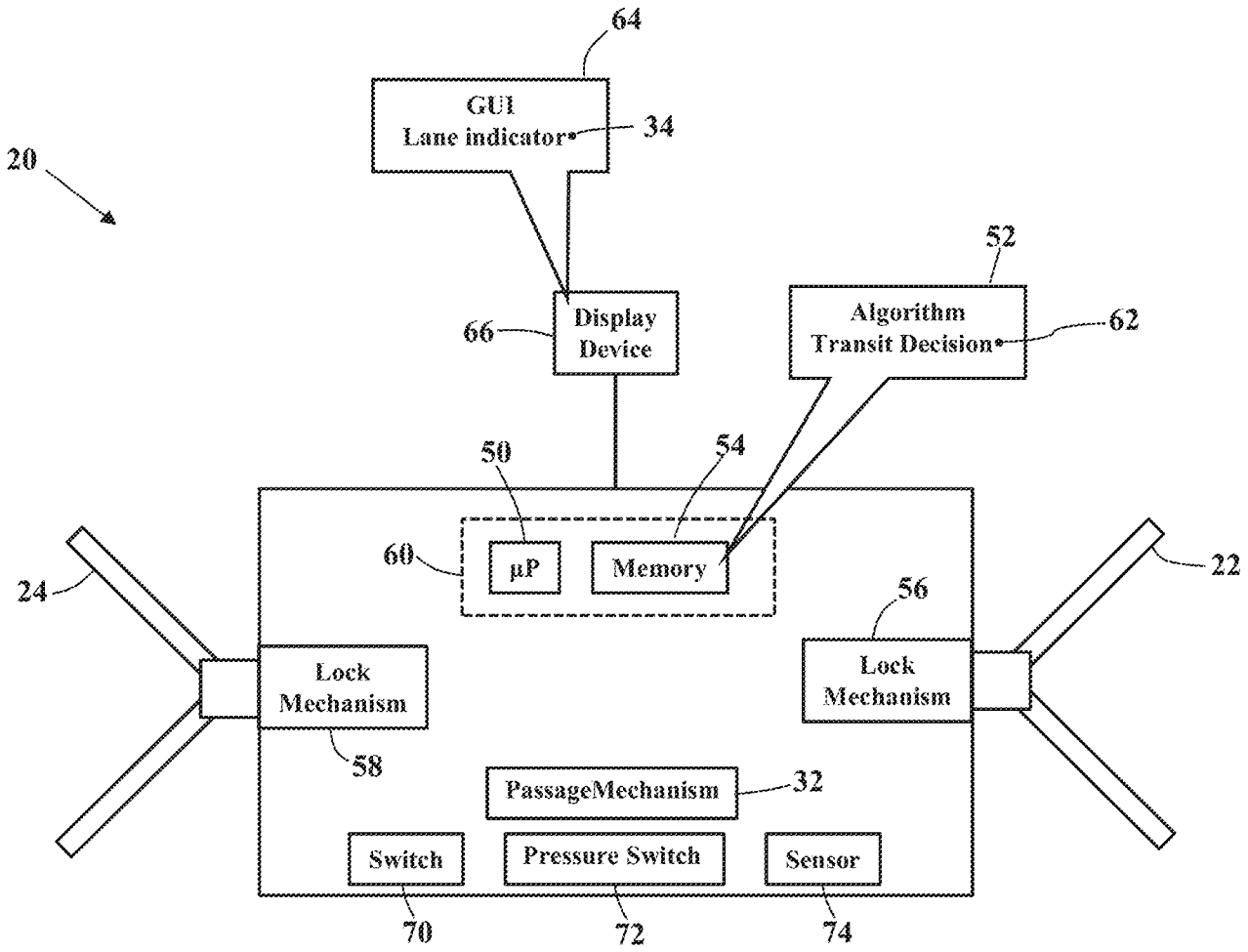
FIG. 3 illustrates an access mechanism, according to exemplary embodiments.

FIG. 3 further illustrates the passage mechanism 32, according to exemplary embodiments. The passage mechanism 32 informs the processor 50 of the presence of the approaching individual. The passage mechanism 32, for example, may include or comprise a switch 70. As the individual approaches the dual turnstile 20, the individual may manually touch or depress the switch 70. The passage mechanism 32 may additionally or alternatively interface with a pressure switch 72 that detects or senses a weight of the individual. The passage mechanism 32 may additionally or alternatively interface with an infrared, ultrasonic, or optical sensor 74. Regardless, the passage mechanism 32 generates an output signal in response to the individual. When the processor 50 receives the output signal, the algorithm 52 instructs the processor 50 to determine the transit decision 62.

Figure 4:
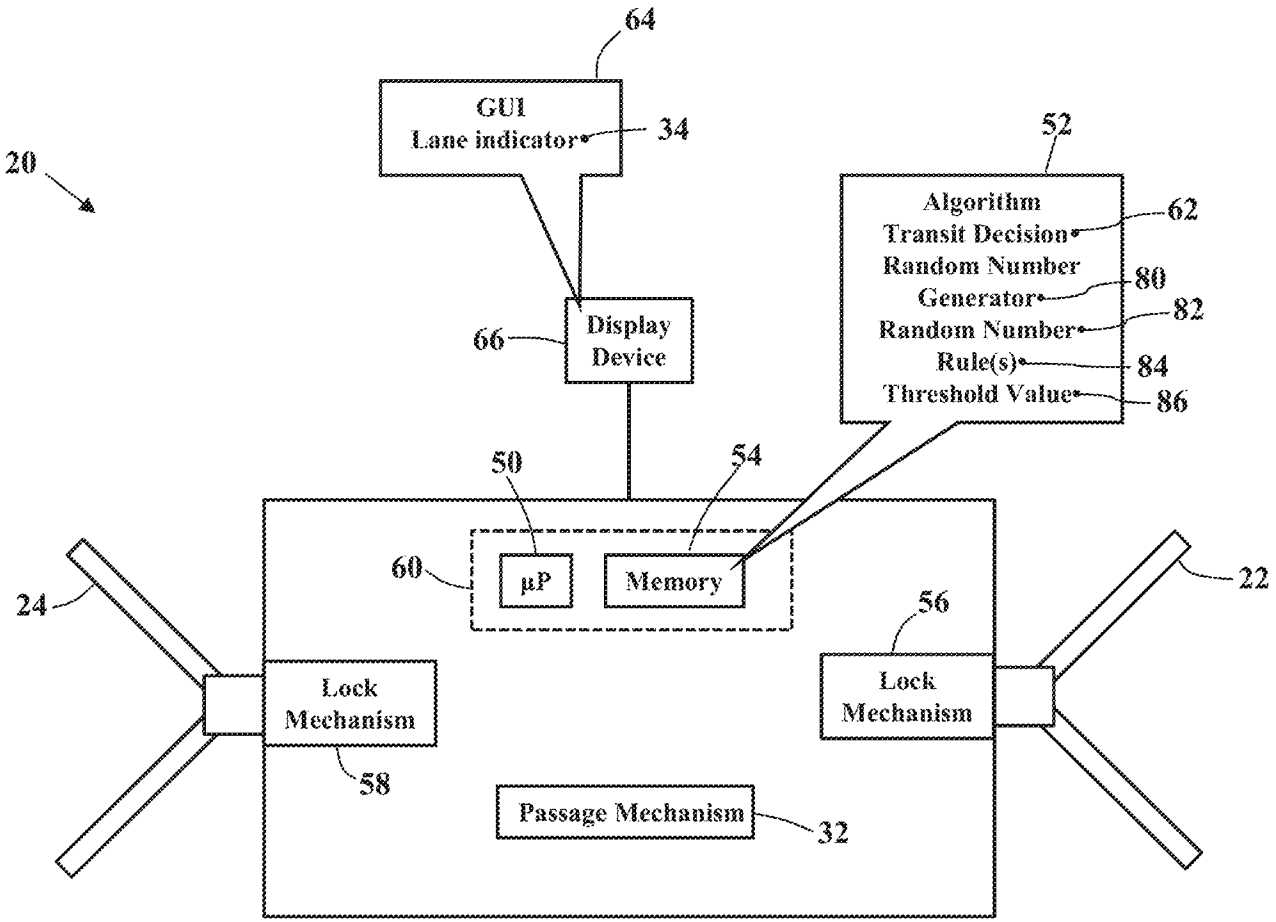
FIG. 4 illustrates random selection, according to exemplary embodiments.

FIG. 4 illustrates random selection, according to exemplary embodiments. Here the processor 50 may randomly select which one of the assemblies 22 or 24 unlocks in the presence of the individual. The algorithm 52, for example, may call a random number generator 80 that generates a random number 82. One or more logical rules 84 may then be executed to determine the transit decision 62. Suppose, for example, the rule 84 specifies:

$$0 \leq (\text{random number}) \leq 1.0;$$

$$\text{if (random number)} < 0.5\text{, select right;}$$

else left.

Here, then, the random number 82 may then be compared to a threshold value 86 (e.g., 0.5) to determine the transit decision 62. If the random number 82 is less than the threshold value 86, then exemplary embodiments may select the right hub and arm assembly 22. If, however, the random number 82 is equal to or greater than the threshold value 86, then exemplary embodiments select the left hub and arm assembly 24.

The threshold value 86, of course, may be configurable. Exemplary embodiments allow an operator or administrator to vary the threshold value 86 to suit any objective. Suppose, for example, the dual turnstile 20 operates in an airport security area. If physical searches are bottlenecking, the operator or administrator may access a configuration GUI or webpage and change the threshold value 86. Using the above rule 84, for example, increasing the threshold value 86 will result in more individuals funneling into the right lane (illustrated as reference numeral 28 in FIG. 1). The threshold value 86, in other words, may be chosen to electronically bias more individuals to one side or the other. It is appreciated that any other suitable mechanism for randomly, or pseudo-randomly, selecting which of assemblies 22 or 24 unlocks in the presence of the individual may alternatively be used, and is contemplated to be within the scope of the invention.

Figure 5:
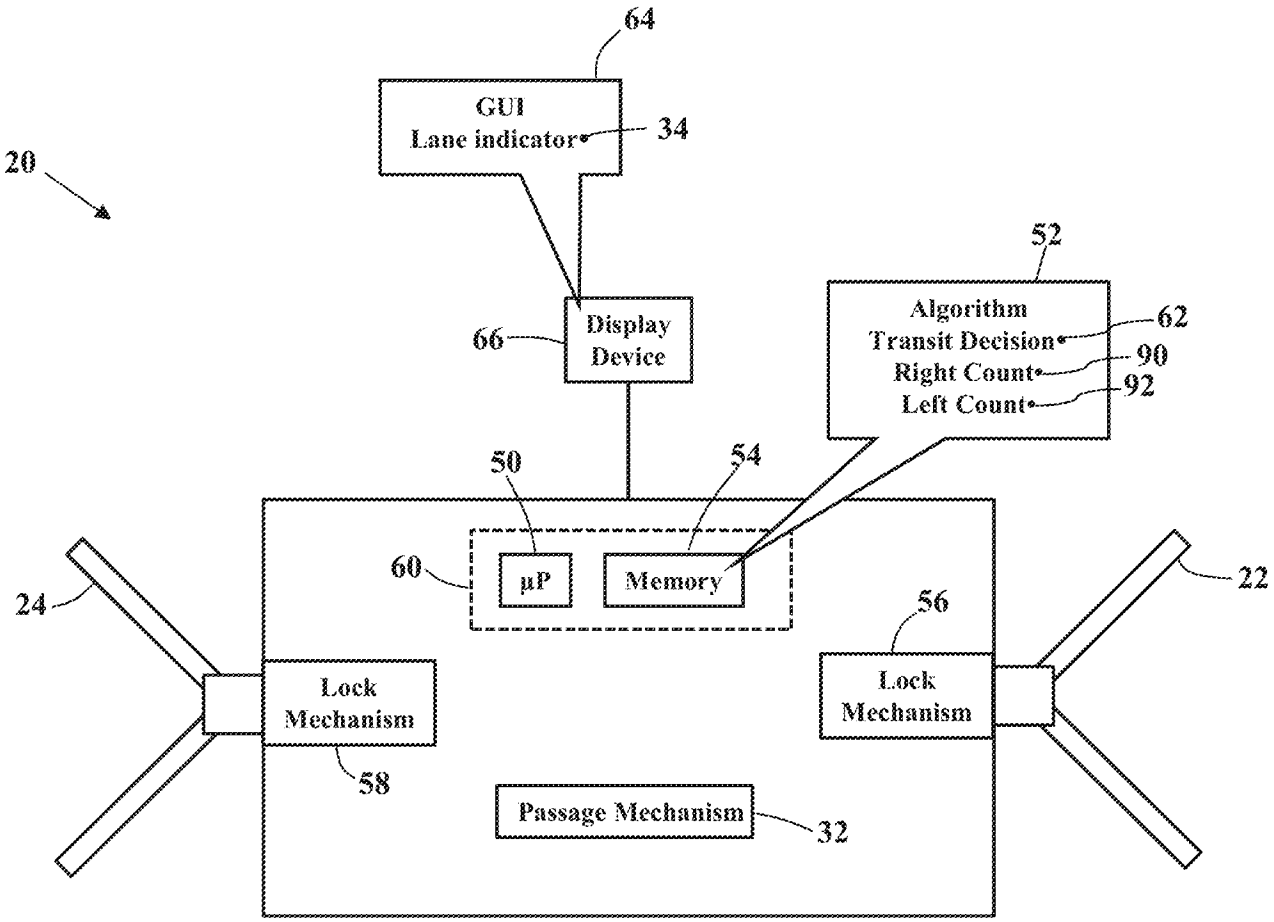
FIG. 5 illustrates equal selection, according to exemplary embodiments.

FIG. 5 illustrates equal selection, according to exemplary embodiments. Here the processor 50 may count or tally the number of individuals that transit each side. The algorithm 52, for example, may instruct the processor 50 to store a right count 90 and a left count 92. As each individual transits, exemplary embodiments may increment the corresponding count 90 or 92. The processor 50 may then compare the right count 90 to the left count 92 to make the transit decision 62. If the right count 90 is lagging, for example, the processor 50 may select the right hub and arm assembly 22 to increase the right count 90. Conversely, if the right count 90 exceeds the left count 92, the processor 50 may select the left hub and arm assembly 24 to increase the left count 92. While exemplary embodiments may alternate selections between the different sides, in actual practice counts may increase in groups. Families, for example, may be directed to one side, while individuals may be directed to the other side. Exemplary embodiments, in other words, may make real time lane decisions to generally achieve an equal, but random, selection process.

Figure 6:
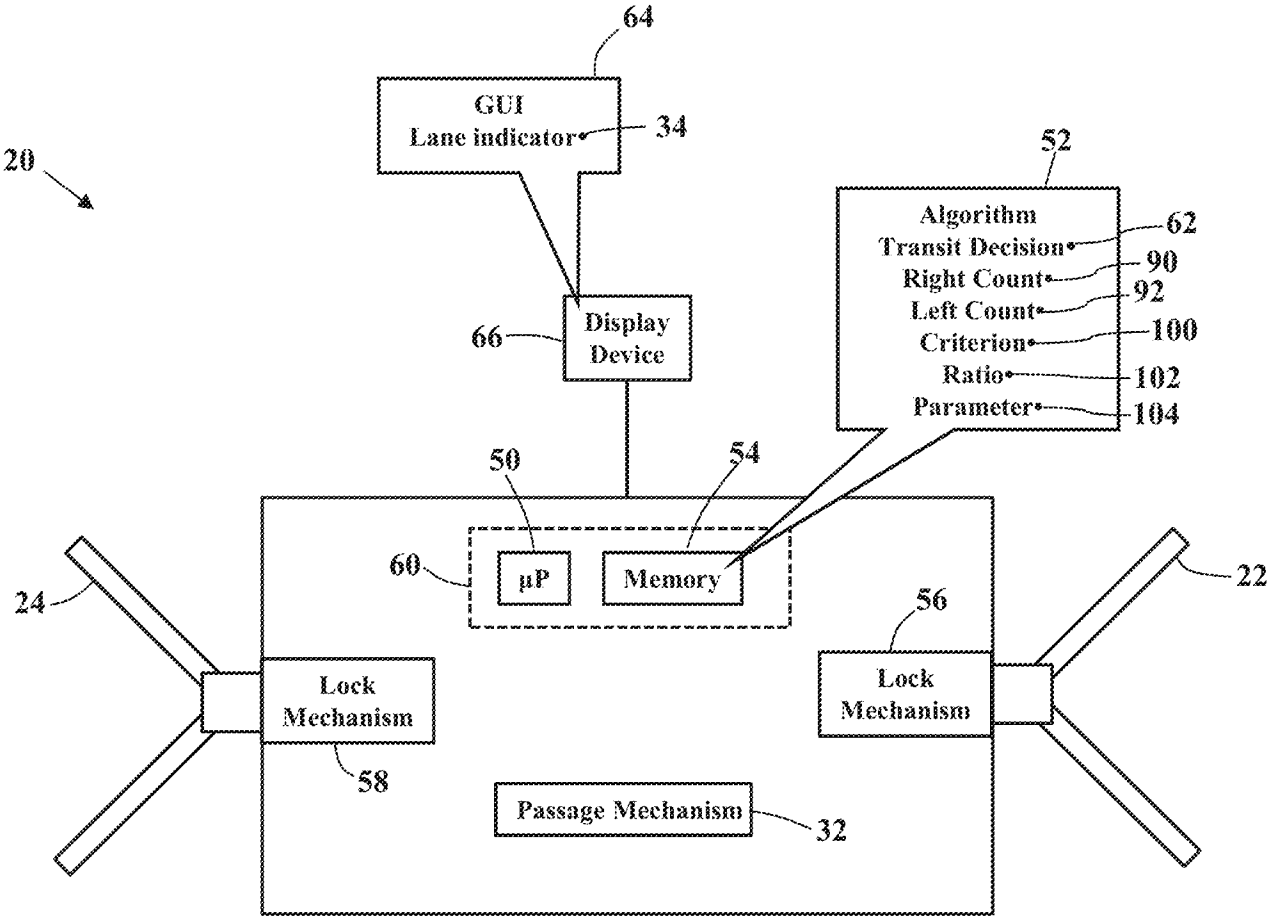
FIG. 6 illustrates unequal selection, according to exemplary embodiments.

FIG. 6 illustrates unequal selection, according to exemplary embodiments. Here exemplary embodiments may select sides based on any criterion 100. Suppose, for example, the right lane 28 is preferred for a (10:1) ratio 102 to the left lane 30. The operator or administrator may access a configuration GUI or webpage and input the ratio 102 as a configuration parameter 104. The processor 50 may then monitor the right count 90 and the left count 92 and make selections to randomly enforce the ratio 102. The ratio 102 may thus be chosen for any objective.

Figure 7:
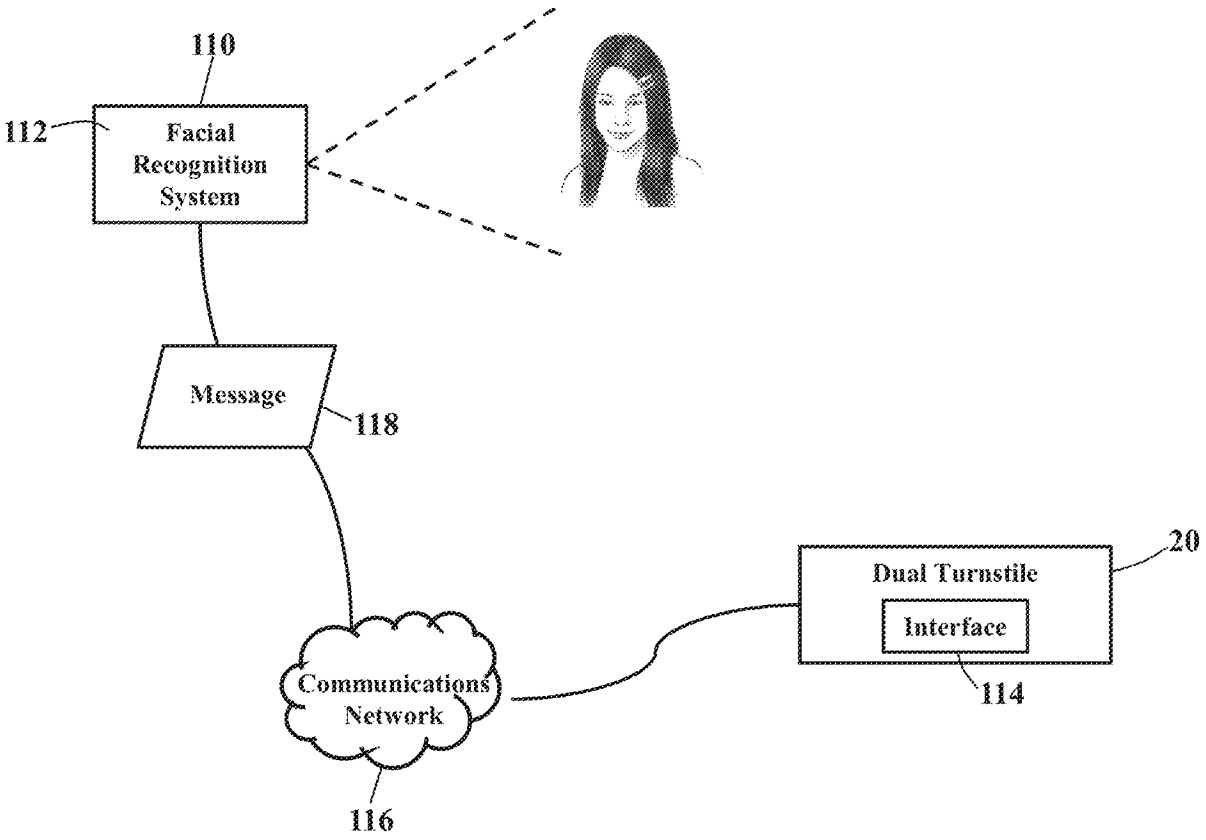
FIG. 7 illustrates facial selection, according to exemplary embodiments.

FIG. 7 illustrates facial selection, according to exemplary embodiments. Here exemplary embodiments may select sides based on a facial recognition system 110. Facial recognition is well known, so the facial recognition system 110 need not be described in detail. As the individual approaches the dual turnstile 20, the facial recognition system 110 may capture a digital image 112 of the individual. If the digital image 112 matches a person of interest, the facial recognition system 110 may inform or notify the dual turnstile 20. Suppose, for example, the dual turnstile 20 has an interface 114 to a communications network 116. The facial recognition system 110 sends a message 118 to a network address associated with the dual turnstile 20. The message 118 includes information that identifies the individual as a security concern. When the dual turnstile 20 receives the message 118, the processor 50 implements the transit decision 62 that is predetermined for security concerns. The individual, for example, is directed to the lane that funnels to security.

Figure 8:
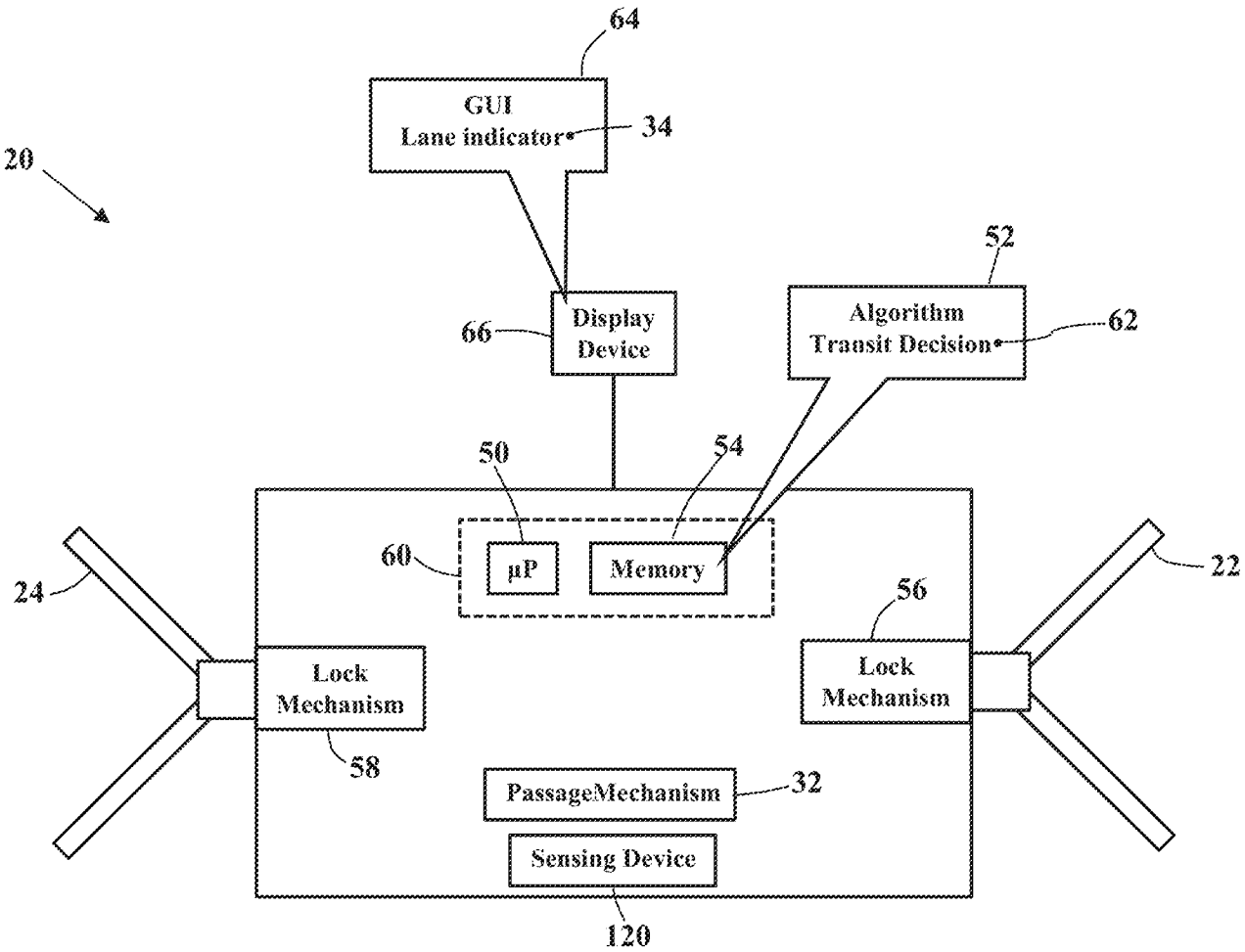
FIG. 8 illustrates biometric selection, according to exemplary embodiments.

FIG. 8 illustrates biometric selection, according to exemplary embodiments. Here exemplary embodiments may select sides based on other biometric traits. Suppose the passage mechanism 32 comprises a fingerprint scanner, iris scanner, or any other sensing device 120. As the individual approaches the dual turnstile 20, the individual may be required to submit to an optical scan. Biometric authentication and verification are well known and need not be explained in detail. If the optical scan presents a security concern, the dual turnstile 20 may again implement the transit decision 62 that is predetermined for security concerns.

Figure 9:
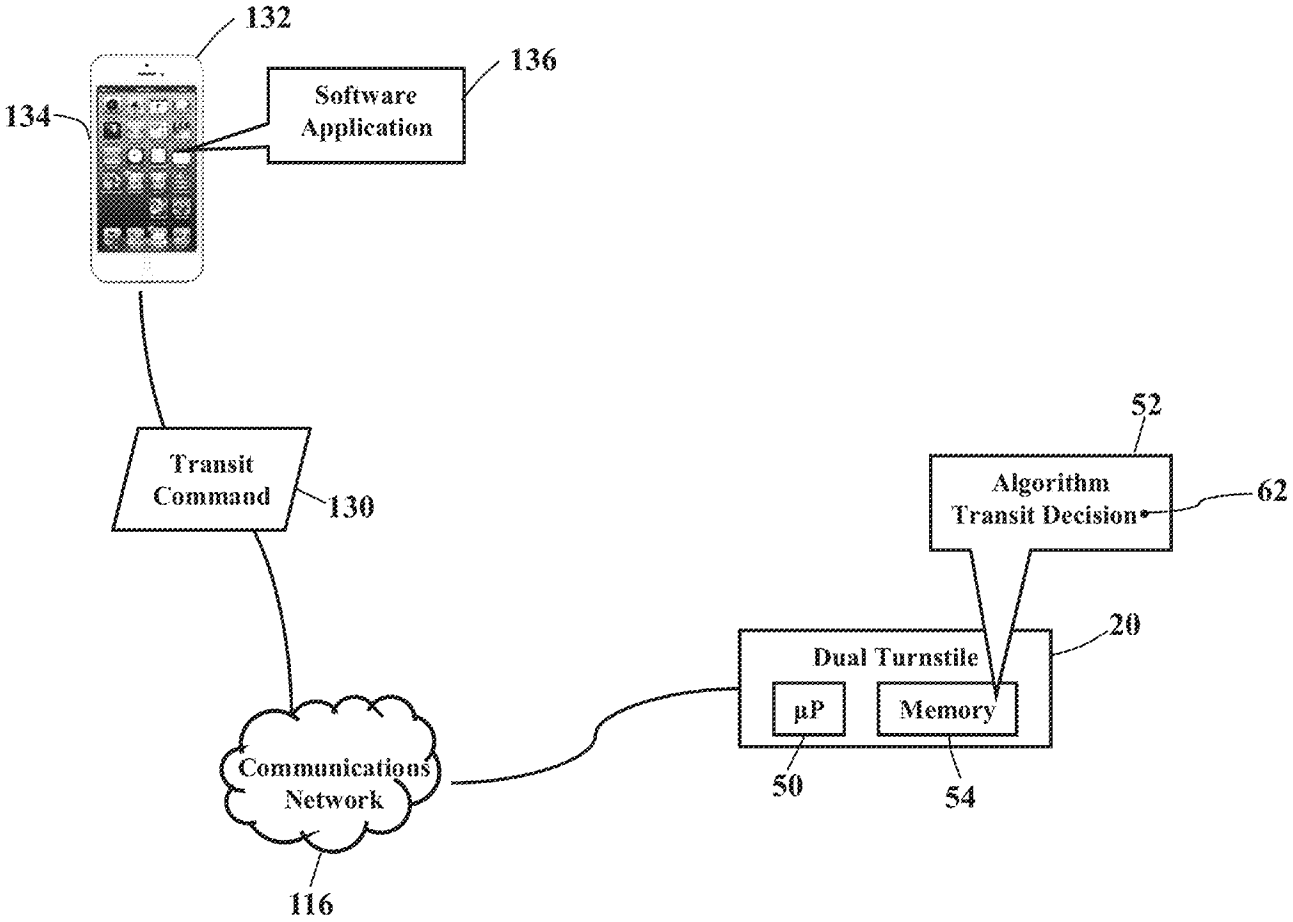
FIGS. 9-11 illustrate transit commands, according to exemplary embodiments.
Figure 10:
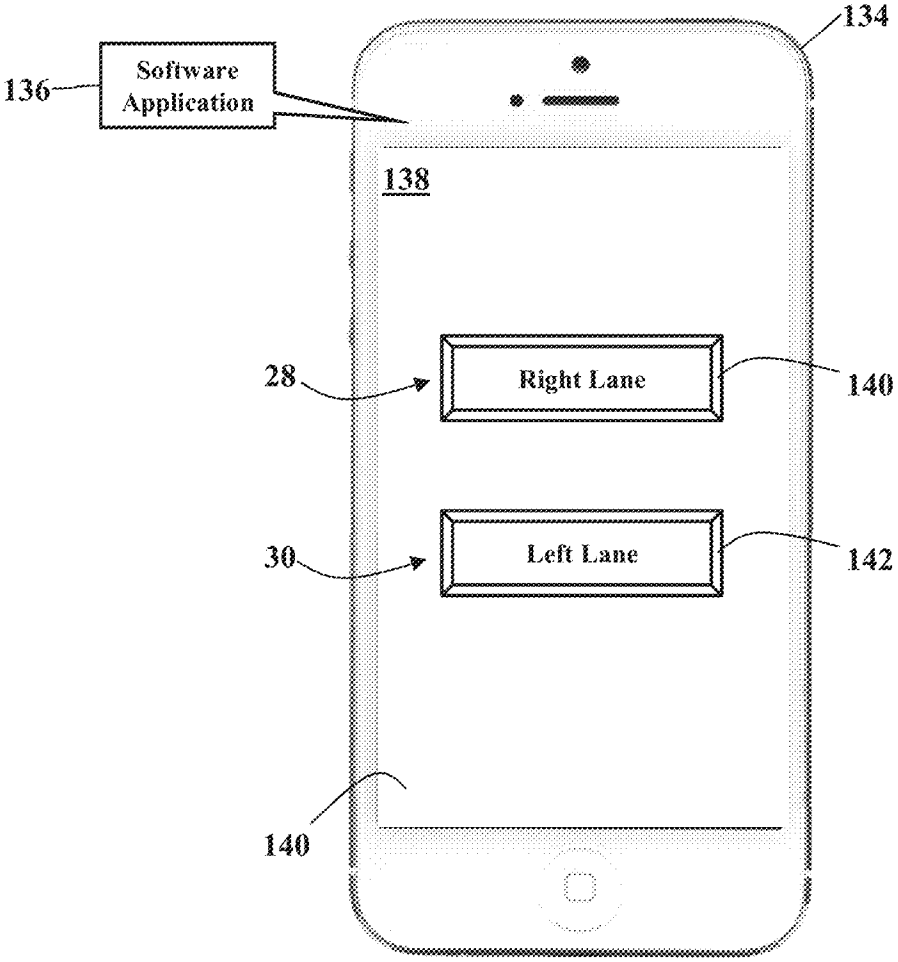
Figure 11:
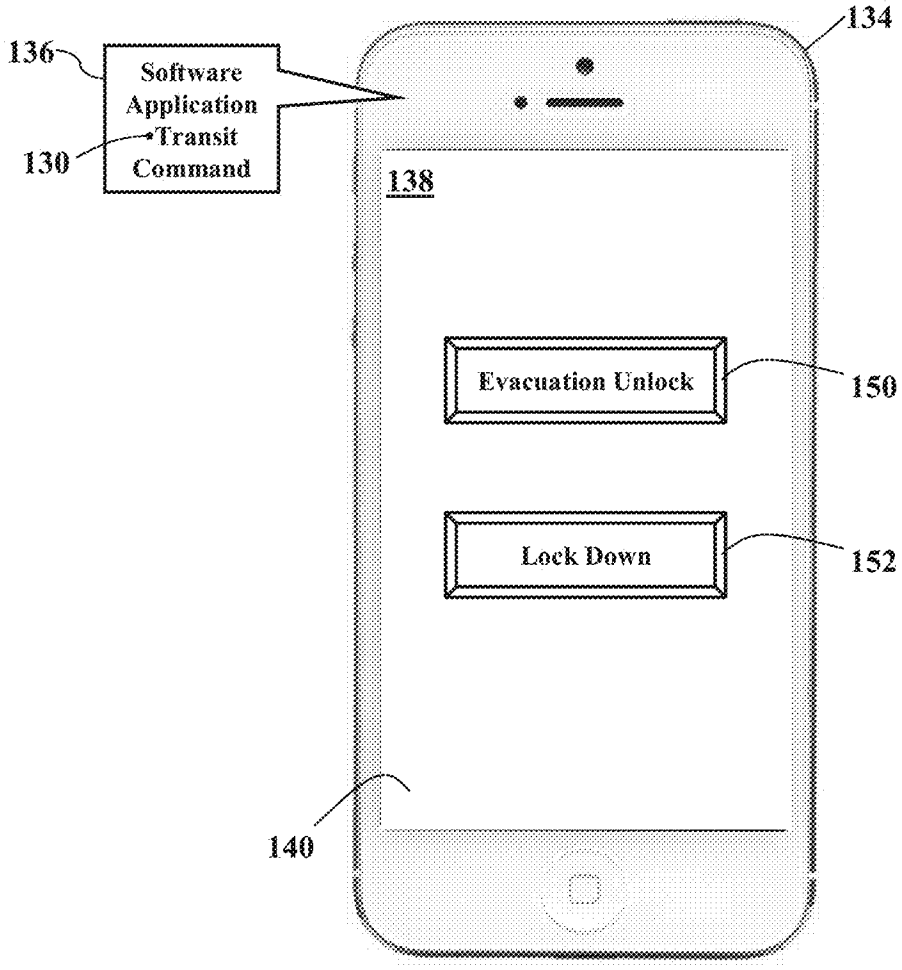

FIGS. 9-11 illustrate transit commands, according to exemplary embodiments. Here exemplary embodiments may remotely lock and unlock either or both sides upon a transit command 130. Suppose, for example, an operator or administrator uses a command device 132 to issue the transit command 130. While the command device 132 may be any processor-controlled device (whether remote or local), FIG. 9 illustrates the command device 132 as a mobile smartphone 134. The operator/administrator uses the smartphone 134 to download a software application 136 that interfaces with the dual turnstile 20 via the communications network 116. The software application 136 is stored in a memory of the smartphone 134, and a processor executes the software application 136. As FIG. 10 illustrates, the software application 136 generates a graphical interface 138 that is displayed by the mobile smartphone 134 (such as by a capacitive or other touch screen 140). The graphical interface 138 allows a user to manually select either the right lane 28 or the left lane 30. The graphical interface 138 may thus display actionable graphical controls for operating the dual turnstile 20. Suppose the graphical interface 138 displays a right lane control button 140 and a left lane control button 142. The operator/administrator may simply graphically or tactilely select either control button 140 or 142 as the individual approaches. Returning to FIG. 9, the smartphone 134 generates and sends the transit command 130 to the network address associated with the dual turnstile 20. The transit command 130 includes information or instructions that cause the processor 50 to generate the transit decision 62, according to the manually-selected control button 140 or 142. The individual is thus funneled according to the transit command 130 sent from the smartphone 134.

FIG. 11 illustrates simultaneous engagement. Here the operator/administrator may simultaneously lock or unlock both lanes 28 and 30. That is, the operator/administrator may remotely lock and unlock both the right hub and arm assembly and the left hub and arm assembly (illustrated, respectively, as reference numerals 22 and 24 in FIG. 1). FIG. 11, for example, illustrates the smartphone 134 generating the graphical interface 138 with an evacuation unlock control button 150 and a lock down control button 152. If the evacuation unlock control button 150 is manually selected, the transit command 130 causes the processor 50 to implement a predefined transit decision 62 that unlocks both the right hub and arm assembly 22 and the left hub and arm assembly 24. Individuals may thus freely pass through the dual turnstile 20. However, selection of the lock down control button 152 causes the dual turnstile 20 to lock both the right hub and arm assembly 22 and the left hub and arm assembly 24. Individuals are thus prevented from transiting through the dual turnstile 20.

Exemplary embodiments may be applied regardless of networking environment. Exemplary embodiments may be easily adapted to stationary or mobile devices having cellular, wireless fidelity (WI-FI®), near field, and/or BLUETOOTH® capability. Exemplary embodiments may be applied to mobile devices utilizing any portion of the electromagnetic spectrum and any signaling standard (such as the IEEE 802 family of standards, GSM/CDMA/TDMA or any cellular standard, and/or the ISM band). Exemplary embodiments, however, may be applied to any processor-controlled device operating in the radio-frequency domain and/or the Internet Protocol (IP) domain. Exemplary embodiments may be applied to any processor-controlled device utilizing a distributed computing network, such as the Internet (sometimes alternatively known as the "World Wide Web"), an intranet, a local-area network (LAN), and/or a wide-area network (WAN). Exemplary embodiments may be applied to any processor-controlled device utilizing power line technologies, in which signals are communicated via electrical wiring. Indeed, exemplary embodiments may be applied regardless of physical componentry, physical configuration, or communications standard(s).

Figure 12:
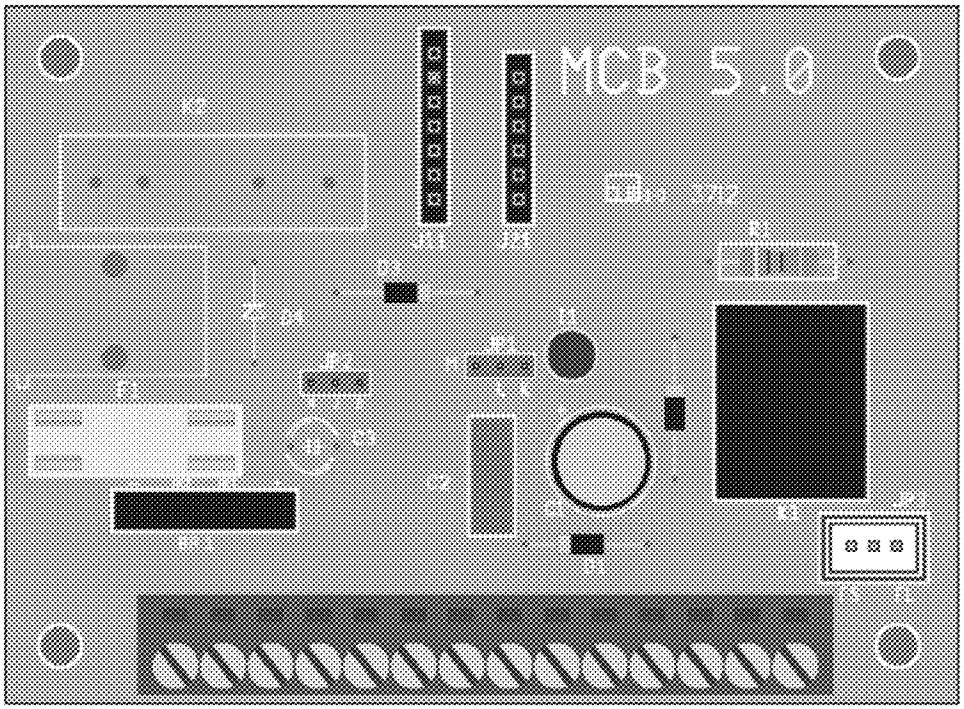
Figure 14:
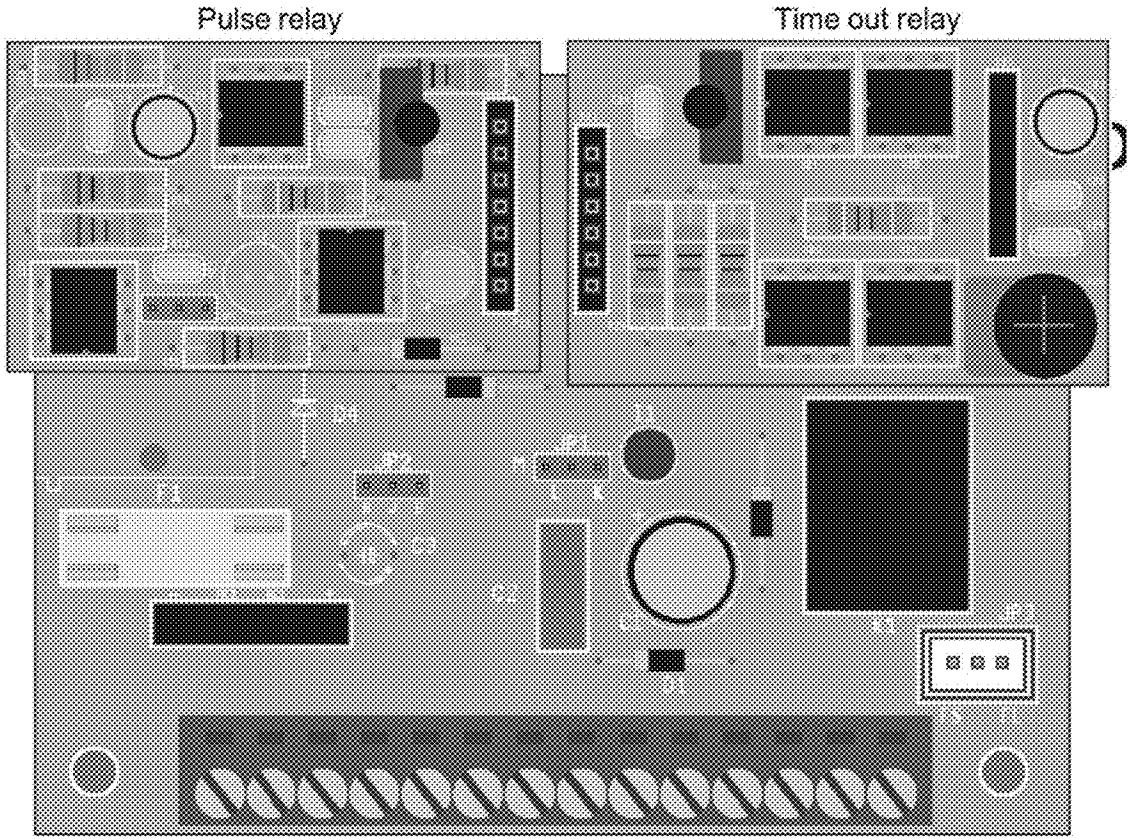

FIGS. 12-14 illustrate circuitry componentry, according to exemplary embodiments. FIG. 12 is an electrical schematic of a main printed circuit board, while FIG. 13 lists example terminal connections. FIG. 14 schematically illustrates electrical optional relays.

Figure 15:
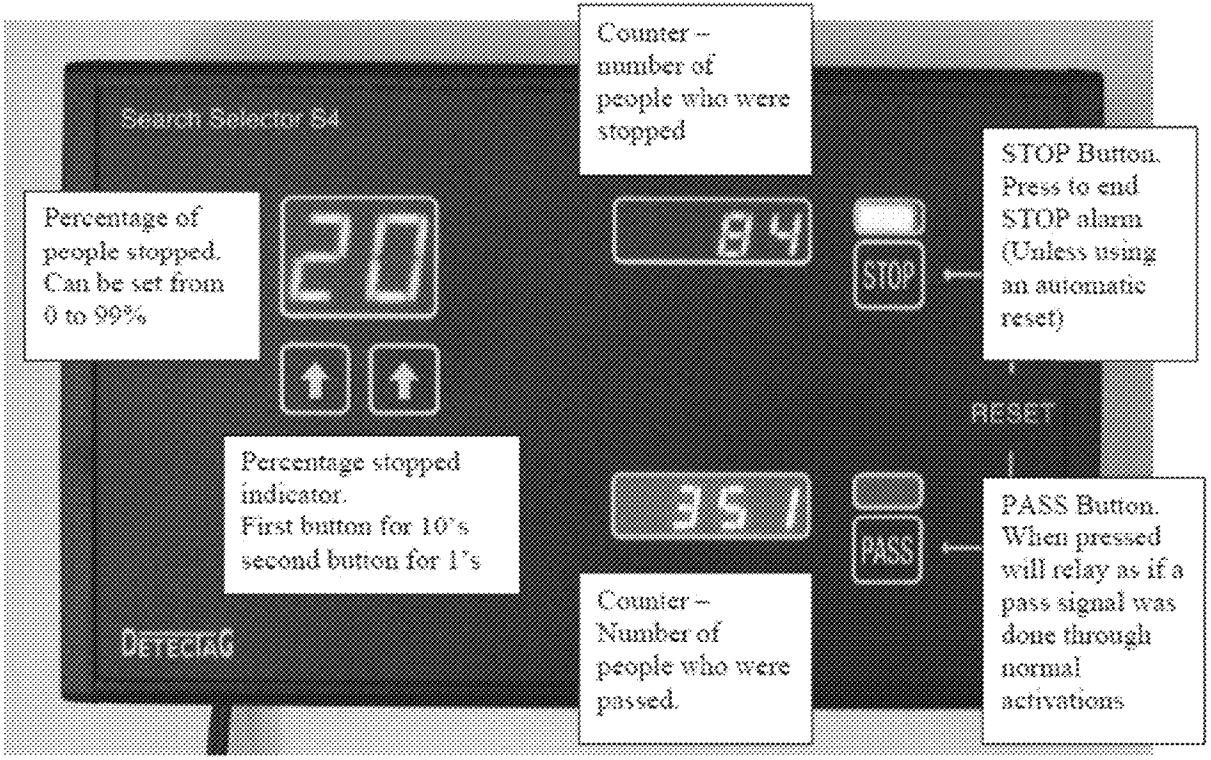
FIG. 15 illustrates a physical interface, according to exemplary embodiments.

FIG. 15 illustrates a physical interface, according to exemplary embodiments. Here exemplary embodiments may visually indicate the right count and the left count (illustrated, respectively, as reference numerals 90 and 92 in FIG. 5). As counts are determined, exemplary embodiments may select lanes based on percentages. As FIG. 15 illustrates, the operator may assign a desired percentage of total transits or rotations to either side of the dual turnstile 20.

Figure 16:
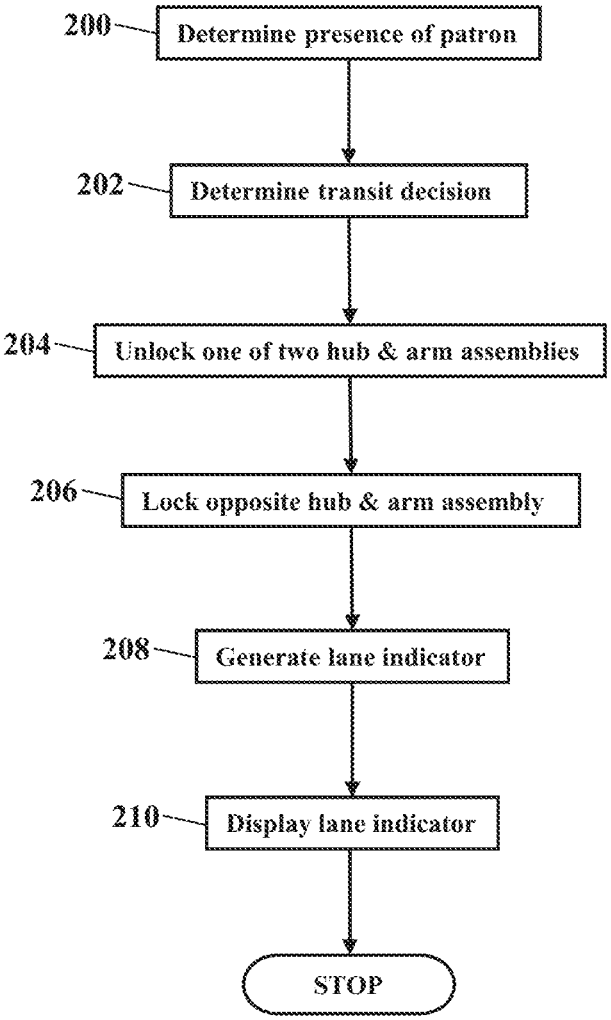
FIG. 16 is a flowchart illustrating a method for transiting an individual, according to exemplary embodiments.

FIG. 16 is a flowchart illustrating a method for transiting an individual, according to exemplary embodiments. A presence of the individual is determined (Block 200) and the transit decision 62 is determined (Block 202). One of the two hub and arm assemblies 22 or 24 is unlocked (Block 204) in response to the transit decision 62, while an opposite one of the two hub and arm assemblies 22 or 24 is locked in response to the transit decision 62 (Block 206). The lane indicator 34 is generated (Block 208) and displayed (Block 210).

Figure 17:
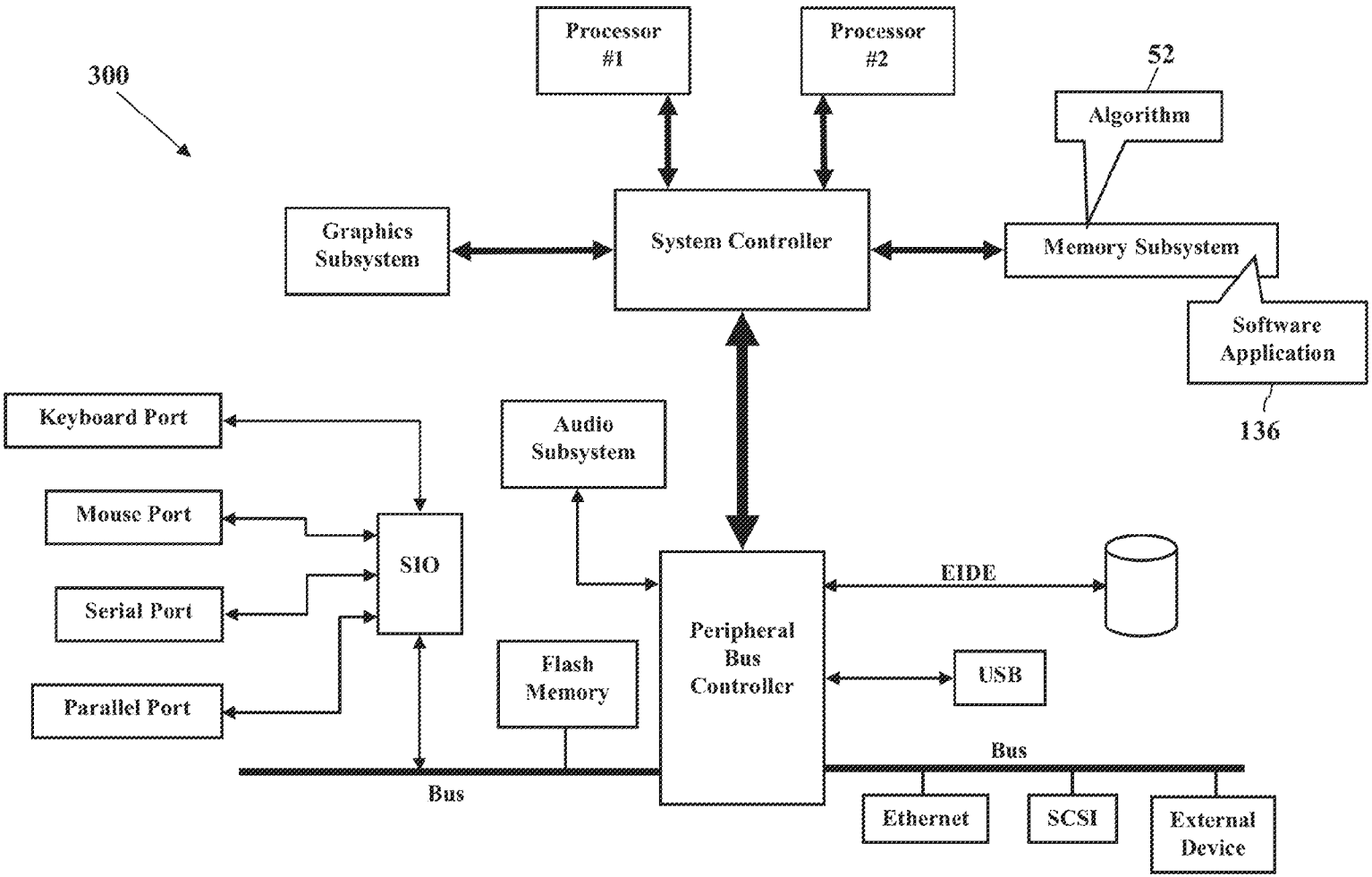
FIG. 17 is a schematic illustrating still more exemplary embodiments.

FIG. 17 is a schematic illustrating still more exemplary embodiments. FIG. 17 is a more detailed diagram illustrating a processor-controlled device 300. As earlier paragraphs explained, the algorithm 52 and/or the software application 136 may partially or entirely operate in any mobile or stationary processor-controlled device. FIG. 17, then, illustrates the algorithm 52 and/or the software application 136 stored in a memory subsystem of the processor-controlled device 300. One or more processors communicate with the memory subsystem and execute either, some, or all applications. Because the processor-controlled device 300 is well known to those of ordinary skill in the art, no further explanation is needed. Moreover, exemplary embodiments may operate within various other processor-controlled devices, such as computers, servers, consumer electronics (e.g., a set-top box, a personal/digital video recorder (PVR/DVR), a Global Positioning System (GPS) device, a television). Moreover, the processor-controlled device 300 may also include wearable devices (such as watches), radios, vehicle electronics, clocks, printers, gateways, mobile/implantable medical devices, and other apparatuses and systems. Because the architecture and operating principles of the various devices 300 are well known, the hardware and software componentry of the various devices 300 are not further shown and described.

Exemplary embodiments may be physically embodied on or in a computer-readable storage medium. This computer-readable medium, for example, may include CD-ROM, DVD, tape, cassette, floppy disk, optical disk, memory card, memory drive, and large-capacity disks. This computer-readable medium, or media, could be distributed to end-subscribers, licensees, and assignees. A computer program product comprises processor-executable instructions for transiting individuals, as the above paragraphs explained.

While the exemplary embodiments have been described with respect to various features, aspects, and embodiments, those skilled and unskilled in the art will recognize the exemplary embodiments are not so limited. Other variations, modifications, and alternative embodiments may be made without departing from the spirit and scope of the exemplary embodiments.

The invention claimed is:

1. A system, comprising:

a. a processor; and b. a memory storing instructions that when executed cause the processor to perform operations, the operations comprising:

i. determining a presence of an individual approaching a turnstile comprising two hub and arm assemblies;

ii. randomly determining a transit decision based on a random number, wherein the random number is compared to a configurable threshold value associated with a side of the dual turnstile;

iii. unlocking one of the two hub and arm assemblies in response to the transit decision; and iv. locking the other one of the two hub and arm assemblies in response to the transit decision.

2. The system of claim 1, wherein the operations further comprise generating a lane indicator for directing the individual to an unlocked one of the two hub and arm assemblies.

3. The system of claim 1, wherein the operations further comprise displaying a lane indicator for directing the individual to an unlocked one of the two hub and arm assemblies.

4. The system of claim 1, wherein the operations further comprise executing a rule to determine the transit decision.

5. The system of claim 1, wherein the operations further comprise counting respective rotations of the two hub and arm assemblies.

6. The system of claim 1, wherein the configurable threshold value is configurable to effect the transit decision to achieve a desired frequency of which at least one of the two hub and arm assemblies is unlocked and locked.

7. The system of claim 1, wherein the configurable threshold value is configurable to bias the transit decision to favor one of the two hub and arm assemblies.

8. The system of claim 1, wherein, the configurable threshold value is configurable to effect the transit decision to achieve a desired ratio of unlocking and locking between the two hub and arm assemblies, and wherein the ratio is based on the counts of rotations associated with the two hub and arm assemblies.

9. A method, comprising:

a. determining, by a turnstile, a presence of an approaching individual;

b. selecting, by the turnstile, one hub and arm assembly of two hub and arm assemblies, wherein the selecting, by the dual turnstile, one hub and arm assembly of two hub and arm assemblies is randomly selected based on a random number, wherein the random number is compared to a configurable threshold value associated with a side of the dual turnstile;

c. unlocking, by the turnstile, the one hub and arm assembly selected; and d. locking, by the turnstile, the other one of the two hub and arm assemblies;

wherein the individual is permitted to transit the one hub and arm assembly selected.

10. The method of claim 9, further comprising generating a lane indicator for directing the individual to the one hub and arm assembly selected.

11. The method of claim 9, further comprising displaying a lane indicator for directing the individual to the one hub and arm assembly selected.

12. The method of claim 9, further comprising executing a rule to select the one hub and arm assembly.

13. The method of claim 9, further comprising counting respective rotations of the two hub and arm assemblies.

14. A memory device storing instructions that when executed cause a processor to perform operations, the operations comprising:

a. receiving a presence of an individual approaching a turnstile comprising two hub and arm assemblies;

b. randomly determining a transit decision based on a random number, wherein the random number is compared to a configurable threshold value associated with a side of the dual turnstile;

c. unlocking one of the two hub and arm assemblies in response to the transit decision; and d. locking the other one of the two hub and arm assemblies in response to the transit decision.

15. The memory device of claim 14, wherein the operations further comprise generating a lane indicator for directing the individual to an unlocked one of the two hub and arm assemblies.

16. The memory device of claim 14, wherein the operations further comprise displaying a lane indicator for directing the individual to an unlocked one of the two hub and arm assemblies.

17. The memory device of claim 14, wherein the operations further comprise executing a rule to determine the transit decision.

18. The memory device of claim 14, wherein the operations further comprise counting respective rotations of the two hub and arm assemblies.

19. A turnstile, comprising:

a. at least two hub and arm assemblies configured to form at least two passageways, wherein the hub and arm assemblies are configured to be selectively at least one of unlocked and locked;

b. a passage mechanism, operably connected to the hub and arm assemblies, wherein upon activation of the passage mechanism at least one of the hub and arm assemblies is selectively unlocked and at least one of the other hub and arm assemblies is locked;

c. an indicator configured to direct an individual, upon activation of the passage mechanism, to an unlocked one of the hub and arm assemblies; and wherein selecting which of the hub and arm assemblies is at least one of locked and unlocked is randomly selected based on a random number, wherein the random number is compared to a configurable threshold value associated with at least one of the hub and arm assemblies.

20. The turnstile of claim 19, wherein the hub and arm assemblies when in an unlocked state are rotatable in one direction.

21. The turnstile of claim 19, wherein selecting which of the hub and arm assemblies is at least one of locked and unlocked is based on a rule.

22. The turnstile of claim 19 further configured to count respective rotations of the hub and arm assemblies.

23. The turnstile of claim 19, wherein the indicator comprises a display displaying a lane indicator for directing the individual to the unlocked one of the hub and arm assemblies.

24. The turnstile of claim 19, wherein the passage mechanism comprises one of a switch, button, touch pad, scanner, and sensor.

25. The turnstile of claim 19, wherein the passage mechanism is remote from the hub and arm assemblies.

* * * * *